United States Patent [19]

Kadija

[11] 4,159,934

[45] Jul. 3, 1979

[54] SELECTIVE PLATING BRUSH APPLICATOR

[76] Inventor: Igor V. Kadija, 1210 Davis Dr., NW., Cleveland, Tenn. 37311

[21] Appl. No.: 857,320

[22] Filed: Dec. 5, 1977

[51] Int. Cl.[2] ..... C25D 17/14; C25D 17/00

[52] U.S. Cl. ..... 204/224 R; 204/271; 204/275; 204/292; 204/294

[58] Field of Search ..... 204/224 R, 275, 271, 204/292, 294

[56] References Cited

U.S. PATENT DOCUMENTS

| | | | |
|---|---|---|---|
| 1,545,942 | 7/1925 | Conlin | 204/224 R |
| 1,866,699 | 7/1932 | Conlin | 204/224 R |
| 1,908,222 | 5/1933 | Conlin | 204/224 R |
| 2,061,591 | 11/1936 | Rapids | 204/224 R |
| 3,619,382 | 11/1971 | Lupinski | 204/224 R X |

*Primary Examiner*—Howard S. Williams
*Assistant Examiner*—D. R. Valentine
*Attorney, Agent, or Firm*—Lamont Johnston

[57] ABSTRACT

A selective plating brush applicator for selectively plating a workpiece. The plating brush consists of an electrically conducting core having a holding means attached to one end of the core for holding the plating brush. A plating current application means is attached to the core for applying a plating current to the core. A brush head is attached to the other end of the core for applying a selective plating solution to the workpiece. The brush head is comprised of anodic electrically conducting flexible fibers and electrically non-conducting flexible fibers which are in liquid communication with each other. The conducting fibers are conductively attached to the core. The conducting and non-conducting fibers are positioned in the brush head in such a manner that when the plating brush is used to apply the plating solution to the workpiece the conducting fibers do not come in contact with the workpiece. The plating brush also has a plating solution supply means for supplying the plating solution to the brush head. When the brush head is placed in contact with the workpiece, plating current applied to the conducting core and workpiece, and plating solution supplied to the brush head, the workpiece is selectively plated.

9 Claims, 4 Drawing Figures

SELECTIVE PLATING BRUSH APPLICATOR

This invention relates to the field of selective plating and particularly relates to selective plating brush applicators.

Selective plating is a known technique of electro deposition. Generally, a power supply provides DC current through two flexible cables; the cathodic cable is clamped to a workpiece and the anodic cable is connected to a selective plating applicator such as a stylus, brush, or spatula.

Selective plating is also known as brush plating, swab plating, touch up plating, stylus plating and tampon plating. It is a method well known in the art. As exemplified by Rubinstein, M. "Highspeed Selective (Brush) Plating" February and March 1976 Electro Plating and Metal Finishing.

Various types of selective plating applicators exist. One well known type applicator is the stylus applicator. The stylus applicator is provided with an anode wrapped with an absorbent cotton swab. The swab and anode are emerged in a special selective plating solution, i.e. an electrolyte. For production work it is preferred to have the plating solution flow or be pumped to the swab. The wrapped anode which is saturated with solution, is then rapidly moved over the surface of the area to be plated. As previously stated, the anodic cable is connected to the stylus and the cathodic cable is attached to the workpiece. The wrapped anode when contacted with the workpiece completes the circuit. Various metals can be deposited from the swab directly onto the area of contact. The stylus generally consists of a conductive core, a plastic handle cover to protect the operator, a means for dissipating the heat generated, and a device for fastening an anodic cable thereto.

Typically, the anode of the stylus selective plating applicator is of a round, flat, half round or circular shape to conform to the surface which is being selectively plated. Flat anodes can have a slight curvature worked into them mechanically, where small ones can be sharpened to a point in a pencil sharpener or ground flat to a screw driver edge.

The anodes are wrapped with an absorbent material the most popular of which is cotton batting.

One of the short comings of the aforementioned stylus type applicator is the fact that various type anodes have to be machined to selectively plate on variously shaped peices.

It is an object of the present invention to provide a selective plating brush applicator which can be utilized to selectively plate different shaped surfaces with a single type brush.

The present invention is directed to a selective plating brush applicator for selectively plating a workpiece. The selective plating brush applicator consists of an electrically conducting core having a holding means attached to one end of the core for holding the plating brush. A plating current application means is attached to the core for applying a plating current to the core. A brush head is attached to the other end of the core for applying a selective plating solution to the workpiece. The brush head is comprised of anodic electrically conducting flexible fibers and electrically non-conducting flexible fibers which are in liquid communication with each other. The conducting fibers are conductively attached to the core. The conducting and non-conducting fibers are positioned in the brush head in such a manner that when the plating brush is used to apply the plating solution to the workpiece the conducting fibers do not come in contact with the workpiece. The plating brush also has a plating solution supply means for supplying the plating solution to the brush head. When the brush head is placed in contact with the workpiece, plating current applied to the conducting core and workpiece, and plating solution supplied to the brush head, the workpiece is selectively plated.

The foregoing objects, advantages and features of the invention will become more apparent from the following specification when taken in connection with the accompanying drawings, where like reference numerals refer to like parts throughout:

Figure 1:
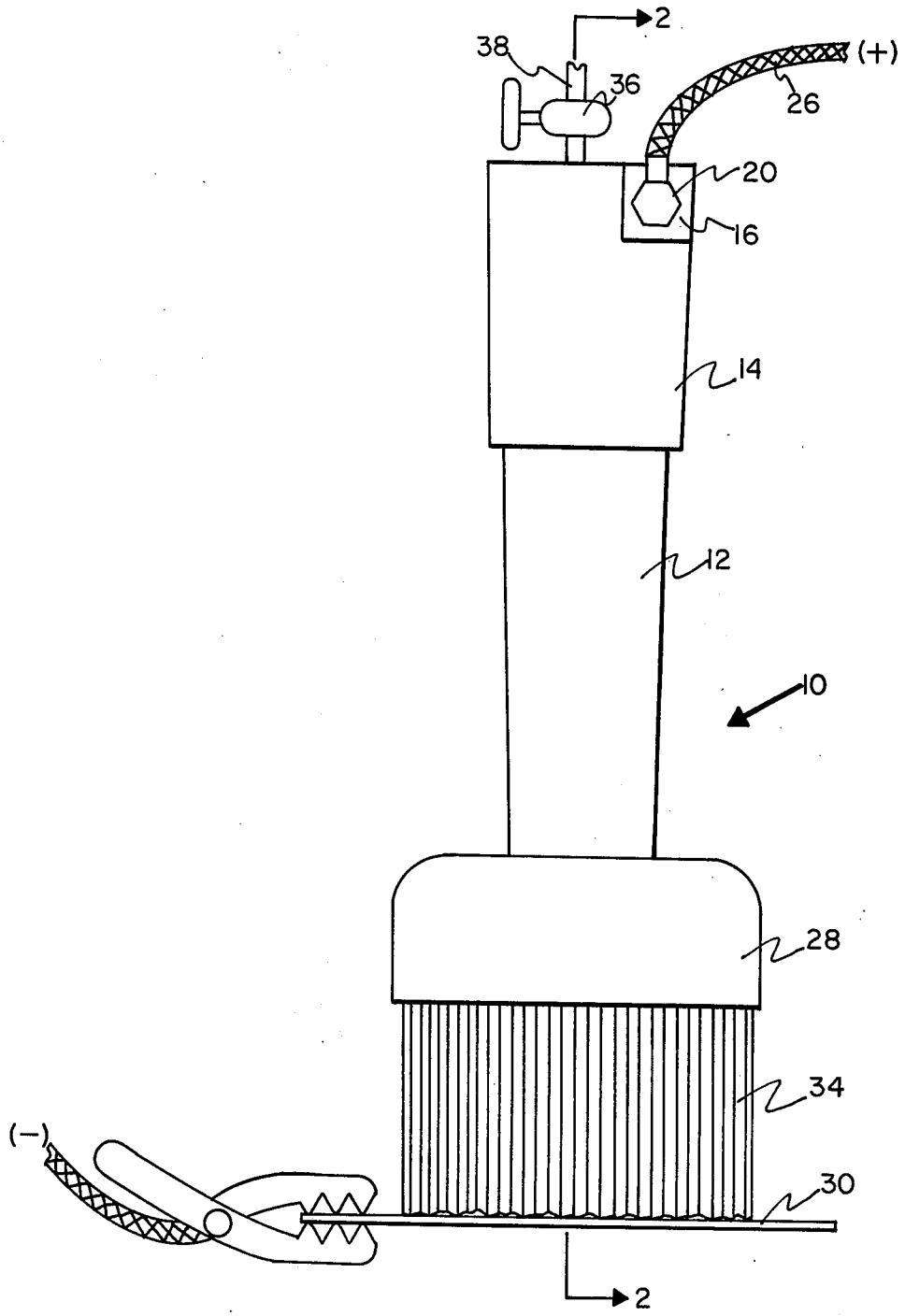
FIG. 1 is a plan view of an embodiment of the plating brush applicator of this invention.

Referring to FIGS. 1 through 4 depicting certain embodiments of this invention, the selective plating brush applicator is generally designated as 10. The selective plating brush applicator 10 consists of an electrically conducting core 12. This core 12 can be constructed of any type material which is electrically conducting, however, it is preferred that the core 12 be of an anodic type electrically conducting material. Typically anodic type electrically conducting materials are, for example, graphite, titanium, platinum and tantalum. A preferred material for the core 12 is graphite.

Generally, the core 12 is of an elongated shape so that a holding means 14 may be attached to the core 12 at one end of the core 12 for holding the plating brush 10. Typically the holding means 14 surrounds the core 12 and is constructed of a non-conducting type material so that one holding the plating brush 10 will not receive any electrical shock.

A plating current application means 16 is attached to the core 12 for applying a plating current to the core 12. As depicted in FIG. 1, the plating current application means 16 may consist of a conducting sheath 18 wrapped around the core 12 and having attached thereto a cable clamp means 20 consisting of, for example, a nut 22 and bolt 24 for attaching a flexible cable 26 thereto. Typically the non-conducting holding means 14 surrounds the sheath 18 to electrically insulate the person utilizing the plating brush 10.

A brush head 28 is attached to the other end of the core 12 for applying a selective plating solution to a workpiece 30. The brush head 28 is comprised of anodic electrically conducting flexible fibers 32 and electrically non-conducting flexible fibers 34 all of these fibers are in liquid communication with each other.

By the use of the term "liquid communication with each other" it is meant that when a fluid, such as the plating solution, is injected at the top of the brush head 28 or the brush head 28 is dipped into the plating solution, the plating solution forms an electrically conducting path along the outer perphery of the fibers 32 and 34. Generally, this means that the fibers 32 and 34 are substantially adjacent to each other and substantially in contact with each other.

The conducting fibers 32 are conductively attached to the core 12. The conducting and non-conducting fibers 32 and 34 are positioned in the brush head 28 in such a manner that when the plating brush 10 is used to apply the plating solution to the workpiece 30 the conducting fibers 32 do not come in contact with the workpiece 30.

Figure 2:
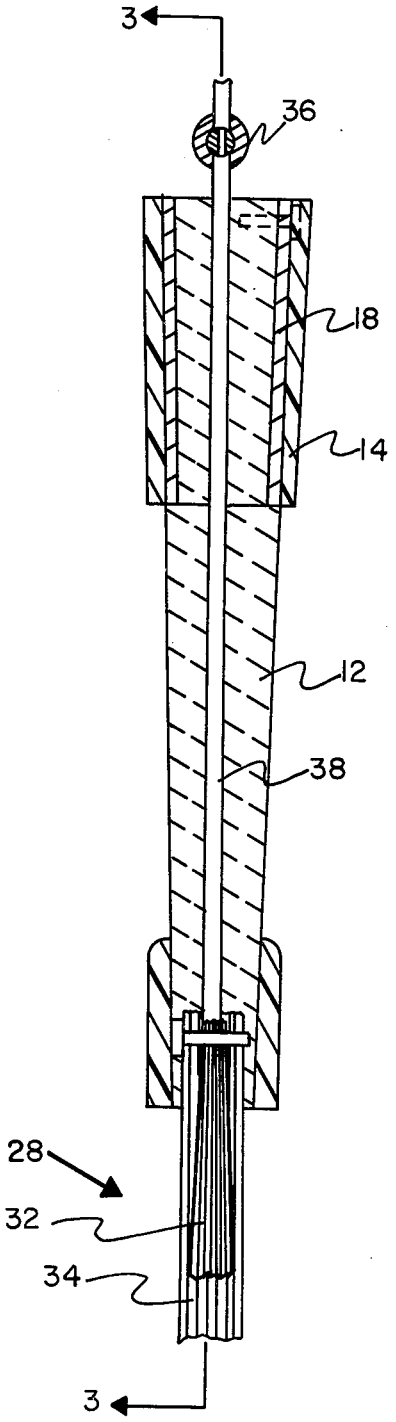
FIG. 2 is a sectional view taken along 2 — 2 of FIG. 1.

In the embodiment depicted in FIG. 2, the brush head 28 is comprised of at least one bundle of conducting fibers 32 surrounded by longer non-conducting fibers 34. A plating brush 10 may consist of many "bundles" of conducting fibers 32 each surrounded by longer non-conducting fibers 34. The number of bundles, the thickness, width and length of the brush head 28 are dependent on the type of job to be accomplished. Heavy duty selective plating would generally require a thicker, wider and longer brush head 28 composed of a plurality of bundles of conducting fibers 32. More delicate selective plating jobs, i.e. artwork, would require only one thin bundle of conducting fibers 32 surrounded by longer non-conducting fibers 34.

Figure 4:
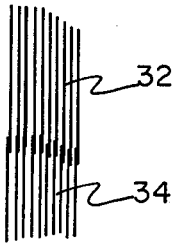
FIG. 4 is an exploded view of another embodiment of the brush head of the plating brush applicator.

In the embodiment depicted in FIG. 4, the non-conducting fibers 34 are attached to the ends of the conducting fibers 32. Surrounding these fibers are non-conducting fibers 34. The fibers may be attached to each other by, for example, epoxy glue.

It is necessary that the conducting fibers 32 do not come in contact with the workpiece 30. Contact with the workpiece 30 will cause a shorting out of the equipment and prevent electro deposition.

Typically the conducting fibers 32 are constructed of anodic electrically conducting materials such as graphite, titanium, platinum and tantalum. Preferably, the conducting fibers 32 are constructed of a flexible graphite material. These flexible graphite fibers are well known in the art, for example, THORNEL, by Union Carbide, New York City, N.Y. The conducting fibers 32 may also be made of drawn wires of other anodic electrically conducting material.

The preferred conducting fibers are made of a special grade of graphite, with metallic impurities kept to a bare minimum to avoid solution contamination. The graphite should be resistent to heat and chemical activity.

Figure 3:
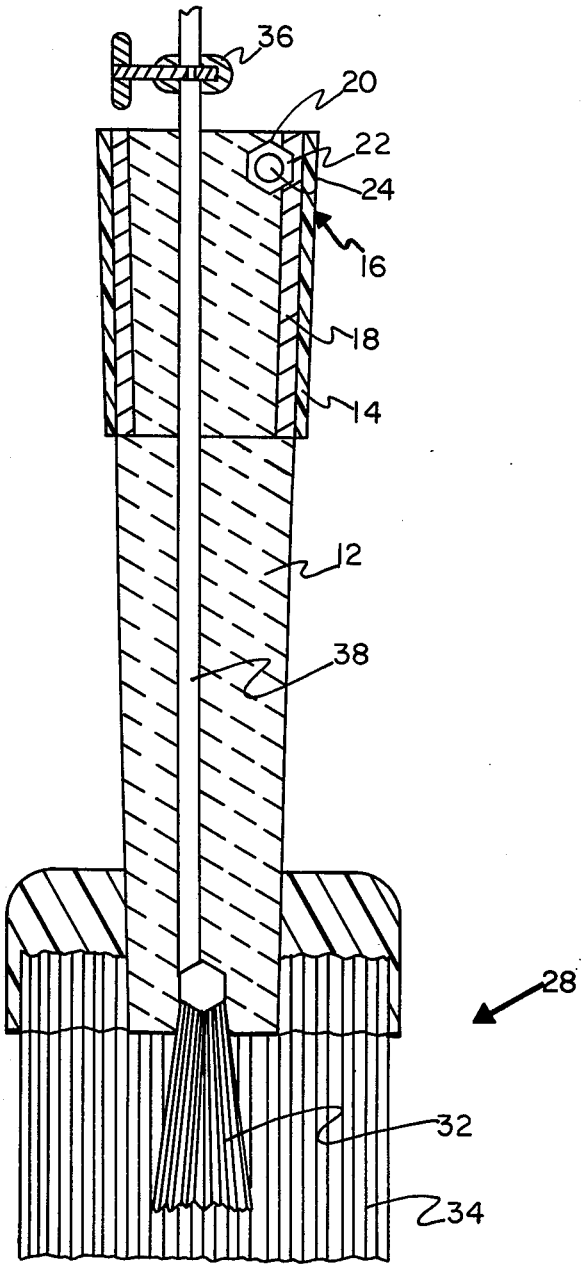
FIG. 3 is a sectional view of the brush applicator depicted in FIGS. 1 and 2 taken along 3 — 3 of FIG. 2.

The brush applicator 10 is further comprised of a plating solution supply means 36 for supplying the plating solution to the brush head 28. As depicted in FIGS. 1 through 3, the supply means 36 is a tubular supply means 38 passing from one end of the core 12 to the conducting fibers 32. Preferrably the plating solution is continuously supplied to the conducting fibers 32. Optionally the plating solution may also be applied to the non-conducting fibers 34 to further insure the continuous flow of electricity from the anodic brush applicator 10 to the cathodic workpiece.

The plating solutions utilized in this invention are the standard electrolite solutions well known in the art. While it is sometimes possible to utilize standard bath plating solutions, this is not advisable, for there exists in the art known electrolite solutions which can perform the task of selectively plating the workpiece 30 more efficiently.

Selective plating solutions generally consist of solutions of organo-metallic chelates, specifically developed for selective plating. Generally, these selective plating solutions are much more concentrated then conventional plating solutions.

Standard bath plating power packs may be utilized to supply the plating current to the plating brush applicator 10. Generally, however, specially designed units are known in the art which provide additional advantages, such as low amperage and relatively high voltage capacities.

It is preferred to utilize an infinitely variably voltage regulater, a reversing switch for striping and cleaning operations and a safety cut out device to protect both the workpiece 30 and the operator. These power pack units are well known in the art.

In use, current is applied to the plating brush applicator 10 and the workpiece, as indicated in FIG. 1. When the brush head 28 is placed in contact with the workpiece 30, the plating current flows through the conducting core 12 and workpiece 30 providing selective plating of the workpiece 30. The plating solution may be continuously fed to the brush head 28 supplying a continuous liquid path through which the plating current may flow.

The construction and arrangements of the parts of the plating brush applicator may be varied within the scope of equivalent limits without departure from the nature and principle of the invention.

What is claimed is:

1. A selective plating brush applicator comprising:

(a) an electrically conducting core:

(b) a holding means attached to one end of the core for holding the plating brush;

(c) a plating current application means attached to the core for applying a plating current to the core;

(d) a brush head attached to the other end of the core for applying a selective plating solution to a workpiece, wherein the brush head is comprised of anodic electrically conducting flexible fibers and electrically non-conducting fibers, wherein the non-conducting fibers are attached to the ends of the conducting fibers, and the conducting fibers are conductively attached to the core, wherein the conducting and non-conducting fibers are positioned in the brush head in such a manner that when the plating brush is used to apply the plating solution to the workpiece the conducting fibers do not come in contact with the workpiece; and (e) a plating solution supply means for supplying the plating solution to the brush head;

whereby when the brush head is placed in contact with the workpiece, plating current applied to the conducting core and workpiece and plating solution supplied to the brush head, the workpiece is selectively plated.

2. The plating brush of claim 1, wherein the core is a graphite core.

3. The plating brush of claim 1, wherein the holding means is an electrically insulated holding means.

4. The plating brush of claim 1, wherein the conducting fibers are graphite fibers.

5. The plating brush of claim 1, wherein the conducting fibers are titanium fibers.

6. The plating brush of claim 1, wherein the conducting fibers are selected from the group consisting of:

(a) graphite, (b) titanium, (c) platinum, and (d) tantalum.

7. The plating brush of claim 1, wherein the brush head is comprised of at least one bundle of conducting fibers surrounded by longer non-conducting fibers.

8. The plating brush of claim 1, wherein the supply means is a tubular supply means passing from one end of the core to the conducting fibers.

9. The plating brush of claim 1, wherein the supply means is a continuous supply means.

* * * * *